US006458041B1

(12) United States Patent
Brandt

(10) Patent No.: US 6,458,041 B1
(45) Date of Patent: Oct. 1, 2002

(54) GOLF BALL PUTTING DEVICE

(76) Inventor: Gary Brandt, 53 Spruce Way, Blackhowk, CO (US) 80403

( * ) Notice: Subject to any disclaimer, the term of this patent is extended or adjusted under 35 U.S.C. 154(b) by 11 days.

(21) Appl. No.: 09/708,298

(22) Filed: Nov. 9, 2000

(51) Int. Cl.[7] ..... A63B 53/06
(52) U.S. Cl. ..... 473/268; 473/265
(58) Field of Search ..... 473/207, 208, 473/210, 211, 217–219, 241, 243, 244, 261, 263, 285, 251–255, 150, 173, 176, 179, 180, 257, 262, 264–266, 268; 248/156, 370

(56) References Cited

U.S. PATENT DOCUMENTS

| | | | | | |
|---|---|---|---|---|---|
| 720,406 | A | * | 2/1903 | Clifforrd | 473/265 |
| 1,091,186 | A | * | 3/1914 | Brown | 473/268 |
| 3,656,752 | A | * | 4/1972 | Moriarty | 473/261 |
| 4,762,325 | A | * | 8/1988 | McCleery | 473/210 |
| 4,796,892 | A | * | 1/1989 | Doerrfeld | 473/268 |
| 5,171,152 | A | * | 12/1992 | McCleery | 473/210 |
| 5,211,400 | A | * | 5/1993 | Hall et al. | 473/268 |
| 5,338,037 | A | * | 8/1994 | Toyohara | 473/268 |

* cited by examiner

*Primary Examiner*—Paul T. Sewell
*Assistant Examiner*—Mitra Aryanpour
(74) *Attorney, Agent, or Firm*—Edwin H. Crabtree; Ramon L. Pizzaro; Donald W. Margolis

(57) ABSTRACT

A golf ball putting device used by a golfer to practice a line of sight directly over the top center of a golf ball when putting the ball. By practicing with the device, the golfer enhances his or her skill in alignment of sight over the top of the golf ball with improved putting skills. The golf ball putting device includes an upright support having a vertical lower portion, a curved middle portion and a horizontal upper portion. The lower portion can be inserted into a ground surface or inserted into a stand. The upper portion includes a forked end. The forked end includes a first fork arm and a second fork arm with an eye alignment opening therebetween. Ends of the first fork arm and the second fork arm are joined together by an elongated upper sight alignment member. The upper sight alignment member, when properly positioned, is parallel to the direction of travel of the golf ball when it is putted. Suspended from opposite ends of the upper sight alignment member are a pair of suspension chains. Lower ends of the chains are attached to opposite ends of an elongated lower sight alignment member. When the upper and lower sight alignment members are placed above the top of the golf ball and the golfer's line of sight aligns the upper sight alignment member above the lower sight alignment member, then the golfer knows his or her line of sight is directly above the golf ball.

9 Claims, 1 Drawing Sheet

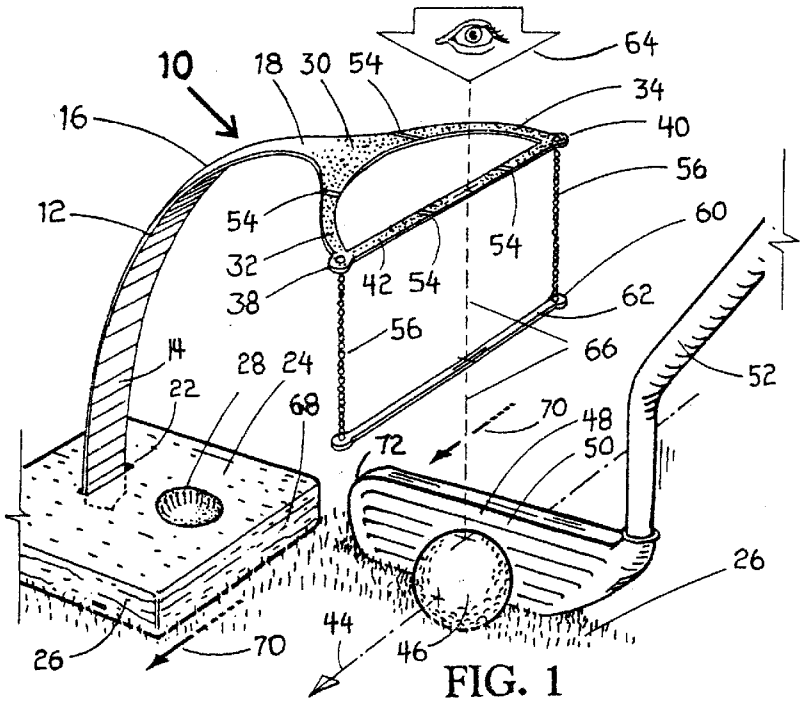
FIG. 1
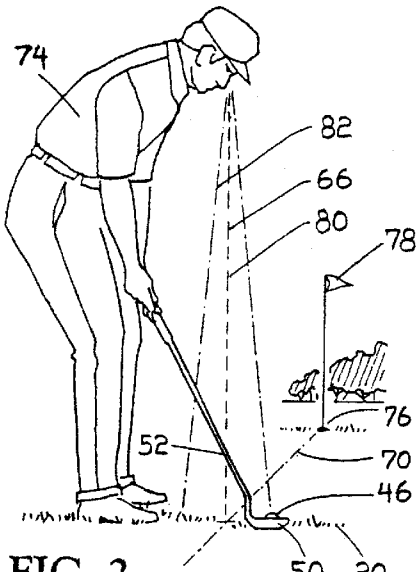
FIG. 2
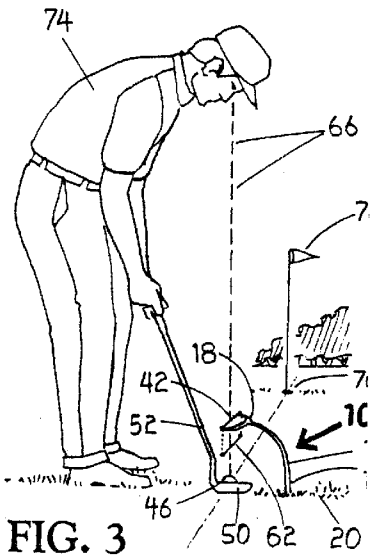
FIG. 3
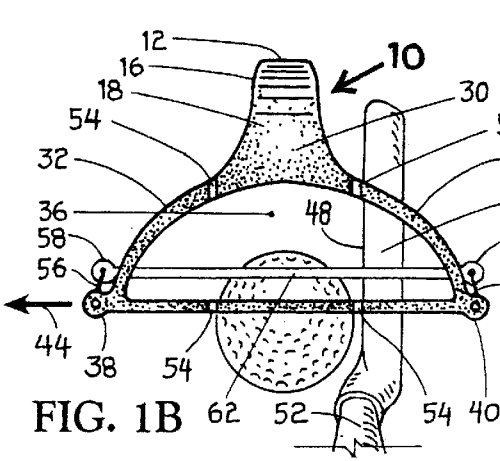
FIG. 1A
FIG. 1B
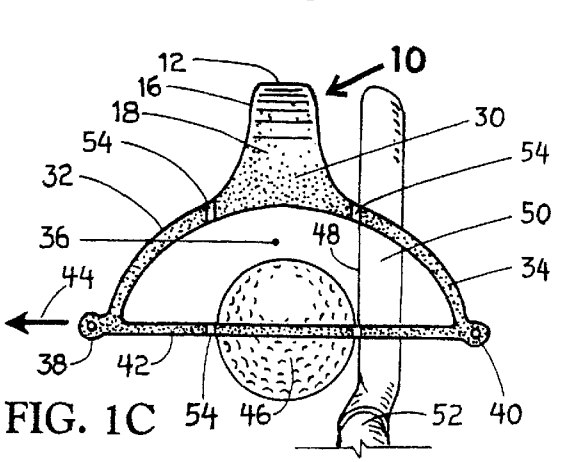
FIG. 1C

GOLF BALL PUTTING DEVICE

BACKGROUND OF THE INVENTION (a) Field of the Invention

This invention relates to practice devices used in the game of golf and more particularly, but not by way of limitation, to a golf ball putting device used by a golfer to practice a line of sight directly over the top of a golf ball and prior to putting the ball.

(b) Discussion of Prior Art

Heretofore, it is well known by professional golfers that when a golfer's line of sight is directly over the top center of the golf ball and on the line of the putt prior to stroking the ball, the golfer's putting accuracy greatly improves. While there are a number of various types of putting devices for practicing putting on a golf green, on indoor and outdoor carpet and other playing surfaces, none of these devices provide for teaching and practicing the correct line of sight directly or vertically over the top center of the ball and on the line of the putt prior to hitting the ball with a putter.

SUMMARY OF THE INVENTION

In view of the foregoing, it is a primary object of the invention to provide a golf ball putting device which can be used by a golfer to practice a line of sight directly over the top center of a golf ball and on the line of the putt when putting the ball.

Another object of the invention is the putting device can be used on a practice putting green, on indoor and outdoor carpet at home or in an office or any other playing surfaces used when practicing putting. The putting device can be used with a stand when practicing on carpet and other surfaces or a lower portion of an upright support can be used for inserting into the ground surface of a putting green.

Still another object of the putting device is by regularly practicing with the putting device, the golfer can enhance his or her skill in the correct alignment of sight over the top of the golf ball when practicing before or after playing a round of golf.

Yet another object of the invention is the putting device is lightweight, durable, portable and can be easily carried in a golfer's golf bag before and after practice. The device is easy to setup and use on a practice putting green prior to and after playing golf and at home or at an office. Also, the device can be used in various types of weather conditions.

A further object of the invention is the device is adaptable for downhill, uphill and other types of sloping golf ball lies. The putting device can be inserted in a putting surface vertically and a various degrees from the vertical as long as a lower sight alignment member is suspended vertically underneath an upper sight alignment member.

The subject golf ball putting device includes an upright support having a vertical lower portion, a curved middle portion and a horizontal upper portion. The lower portion can be inserted into a ground surface or inserted into a stand. The horizontal upper portion includes a forked end. The forked end includes a first fork arm and a second fork arm with an eye alignment opening therebetween. Ends of the first fork arm and the second fork arm are joined together by an elongated upper sight alignment member. The upper sight alignment member, when properly positioned, is parallel to the direction of travel of the golf ball when it is putted. Suspended from opposite ends of the upper sight alignment member are a pair of suspension chains. Lower ends of the chains are attached to opposite ends of a weighted elongated lower sight alignment member. When the upper and lower sight alignment members are placed directly above the top of the golf ball and the golfer's line of sight aligns the upper sight alignment member above the lower sight alignment member, then the golfer knows his or her line of sight is directly above the golf ball for practicing with improved putting skill.

These and other objects of the present invention will become apparent to those familiar with practice devices used in the game of golf as described in the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which:

FIG. 1 is a perspective view of the subject golf practice device shown with an elongated upper sight alignment member and a lower sight alignment member properly aligned with the golfer's line of sight. The line of sight is shown in dashed lines and directly above a top of a golf ball.

FIG. 1A is a top view of the practice device and illustrating when the golfer's line of sight is not directly above the top of the golf ball. In this example, the golfer is standing too far away from the line of sight above the ball and the lower sight alignment member is not aligned directly underneath the upper sight alignment member.

FIG. 1B is a top view of the practice device and illustrating again when the golfer's line of sight is not directly above the top of the golf ball. In this example, the golfer is standing too far forward over a line of sight above the ball and the lower sight alignment member is not aligned underneath the upper sight alignment member.

FIG. 1C is a top view of the practice device and illustrating when the golfer's line of sight is vertically downward and directly above the top center of the golf ball. In this example, the lower sight alignment member is properly aligned and hidden underneath the upper sight alignment member.

FIG. 2 is a perspective view of the golfer addressing a golf ball with his putter and without the golfer's line of sight directly above the top center of the golf ball and prior to stroking the golf ball toward a golf cup. This drawing illustrates the golfer's line of sight as shown in FIG. 1A.

FIG. 3 is a perspective view of a golfer addressing a golf ball with his putter and with the golfer's line of sight directly above the top center of the golf ball. This drawing illustrates the correct golfer's line of sight as shown in FIGS. 1 and 1C.

DESCRIPTION OF THE PREFERRED EMBODIMENTS

In FIG. 1, a perspective view of the subject golf ball putting device is shown and having general reference numeral 10. The practice device 10 includes an upright support 12 having a vertical lower portion 14, a curved middle-portion 16 and a horizontal upper portion 18. The lower portion 14, having a pointed end, can be inserted into a ground surface 20 of a putting green, as shown in FIG. 3, or inserted into slot 22 in a portable stand 24. In this example, the portable stand 24 is resting on top of a portion of carpet 26. The carpet 26 may be indoor or outdoor carpet used in a home or office where putting is practiced. The portable stand 24 includes a small circular cavity 28 for holding a golf ball.

The horizontal upper portion 18 includes a forked end 30. The forked end 30 is characterized by having a first fork arm 32 and a second fork arm 34 with an eye alignment opening 36 therebetween. An end 38 of the first fork arm 32 and an end 40 of the second fork arm 34 are joined together by opposite ends of an elongated upper sight alignment member 42.

The upper sight alignment member 42, when properly positioned, is parallel to the direction of travel, as indicated by arrow 44, of a golf ball 46 when the ball is putted. In this drawing, the golf ball 46 is disposed next to a face 48 of a putter head 50 of a golf putter 52. Also, the upper sight alignment member 42, when properly aligned with the golf ball 46, is positioned directly above the top of the golf ball as shown. Also, the forked end 30 and the upper sight alignment member 42 include a pair of spaced apart ball and putter face alignment stripes 54. The two pair of alignment stripes 54 are used to help position the face 48 of the putter head 50 perpendicular to the ball 46.

Suspended from the opposite ends. 38 and 40 of the upper sight alignment member 42 are a pair of suspension chains 56. Lower ends of the chains 56 are attached to opposite ends 58 and 60 of an elongated lower sight alignment member 62. The lower sight alignment member 62 may be weighted or made of a heavy metal so that when suspended by gravity it will not tend to move during windy weather conditions. It should by noted that the lower sight alignment member 62 is a key feature in the subject invention and acts as a pendulum suspended below the upper sight alignment member 42. Also, the lower sight alignment member 62 is similar in size and shape when compared to the upper sight alignment member 42.

When the upper and lower sight alignment members 42 and 62 are placed directly above the top center of the golf ball 46 and the golfer's line of sight aligns the upper sight alignment member 42 directly above the lower sight alignment member 62, then the golfer knows his or her line of sight is directly above the golf ball for practicing with improved putting skill. In this drawing, the golfer's eye is shown as a large arrow 64 and the proper vertical line of sight is shown as dashed lines 66. The elongated upper sight alignment member 42 and a lower sight alignment member 62 are properly aligned with the golfer's line of sight 66 and above the top center of the golf ball 46.

The stand 24 includes a front edge portion 68, which is parallel to the movement of the putter head 50 as indicated by arrows 70. By placing a nose 72 of the putter head 50 next to front edge portion 68, the front edge portion 68 acts as a guide for the putter 52 during the stroking of the golf ball 46.

In FIG. 1A, a top view of the putting device 10 is illustrated. In this drawing, the golfer's line of sight is not directly above the top of the golf ball 46. The golfer, in this example, is standing to far away from a vertical line of sight above the ball. This is apparent in that the lower sight alignment member 62 can be seen suspended in front of the upper sight alignment member 42 and therefore not aligned directly underneath the upper sight alignment member 42.

In FIG. 1B, a top view of the putting device 10 is shown wherein the golfer's line of sight is again not directly above the top center of the golf ball 46. In this example, the golfer is standing to far forward over a line of sight above the ball. This is apparent by looking through the eye alignment opening 36 in the forked end 30 and seeing the lower sight alignment member 62 suspended in back of the upper sight alignment member 42 and therefore not aligned underneath the sight alignment member 42.

In FIG. 1C, a top view of the putting device 10 is illustrated wherein the golfer's line of sight is vertically downward and directly above the top center of the golf ball 46 as shown in FIG. 1. In this example, the lower sight alignment member 62 is properly aligned and completely hidden underneath the upper sight alignment member 42.

In FIG. 2, a perspective view of a golfer 74 is shown addressing the golf ball 46 with his putter 52 and without the golfer's line of sight directly above the top of the golf ball 46 and prior to stroking the golf ball 46 toward a golf cup 76 with golf cup flag 78. The improper line of sight is indicated by dashed lines 80. This drawing illustrates the golfer's improper line of sight from standing too far away from a vertical line of sight above the ball as shown in FIG. 1A. Also, an improper line of sight is indicated by dashed lines 82. The dashed lines 82 represent the golfer 74 standing too far forward over a line of sight above the ball as shown in FIG. 1B.

In FIG. 3, another perspective view of the golfer 74 is shown addressing the golf ball 46 with his putter 52. In this example, the golfer's line of sight, as shown in dashed line 66, is directly above the top of the golf ball 46. This drawing illustrates the correct golfer's line of sight as shown in FIGS. 1 and 1C. As mentioned above, the pointed end of the lower portion 14 of the support 12 can be used for inserting into the ground surface 20 of a golf green. Also, the support 12 should hold the lower sight alignment member 62 above the golf ball 46 and sufficient room is provided so that the top of the putter head 50 doesn't contact the member 62 during the putting stroke. Further, is should be mentioned that the support 12 can be inserted at various angles from the vertical and into a ground surface that an uphill, downhill or other sloping surface as long as the lower sight alignment member 62 is freely suspended below the upper sight alignment member 42.

While the invention has been shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A golf ball putting device used by a golfer to practice a vertical line of sight directly over the top of a golf ball when putting the ball with a golf putter, the putting device comprising:

an upright support having a vertical lower portion with a pointed end for inserting in the ground surface or in the stand, a curved middle portion and a horizontal upper portion;

a forked end formed in an end of the upper portion of said upright support, said forked end having a first fork arm, a second fork arm and an eye alignment opening therebetween, an elongated upper sight alignment member attached to ends of the first fork arm and the second fork arm of said forked end; and a pair of suspension chains, upper ends of said chains attached to opposite ends of said elongated upper sight alignment member and suspended therefrom, and an elongated lower sight alignment member attached to lower ends of said chains and suspended therefrom, said lower sight alignment member the same size and shape as said upper sight alignment member;

whereby, when said upper and lower sight alignment members are placed above the top of the golf ball and the golfer's line of sight aligns said upper sight alignment member above said lower sight alignment member, the golfer knows his or her line of sight is directly above the golf ball.

2. The putting device as described in claim 1 wherein said lower sight alignment member is the same size and shape as said upper sight alignment member, said upper sight alignment member having a cross hair centered along a length thereof.

3. The putting device as described in claim 1 wherein the lower portion of said upright support includes a pointed end, the pointed end used for inserting a portion of the upright support into a putting green surface.

4. The putting device as described in claim 1 further including a stand having a slot in the top thereof and the lower portion of said upright support includes a pointed end, the pointed end used for inserting the slot of said for holding the putting device in an upright position.

5. The putting device as described in claim 4 wherein said stand includes a front edge portion, said front edge portion used as a guide for the golf putter when putting the golf ball disposed under said upper and lower sight alignment members.

6. A golf ball putting device used by a golfer to practice a vertical line of sight directly over the top of a golf ball when putting the ball with a golf putter, the putting device comprising:

an upright support having a vertical lower portion, a curved middle portion and a horizontal upper portion;

a forked end formed in an end of the upper portion of said upright support, said forked end having a first fork arm, a second fork arm and an eye alignment opening therebetween;

an elongated-upper sight alignment member attached to ends of the first fork arm and the second fork arm of said forked end;

an elongated lower sight alignment member; and a pair of suspension chains, upper ends of said chains attached to opposite ends of said upper sight alignment member and suspended therefrom, lower ends of said chains attached to opposite ends of said lower sight alignment member;

whereby, when said upper and lower sight alignment members are placed above the top of the golf ball and the golfer's line of sight aligns said upper sight alignment member above said lower sight alignment member, the golfer knows his or her line of sight is directly above the golf ball.

7. The putting device as described in claim 6 wherein said lower sight alignment member is the same size and shape as said upper sight alignment member, said upper sight alignment member having a cross hair centered along a length thereof.

8. The putting device as described in claim 6 wherein said upper sight alignment member includes a pair of spaced apart alignment stripes thereon and adapted for aligning the golf ball therebetween.

9. The putting device as described in claim 6 wherein said forked end includes a pair of spaced apart alignment stripes thereon and adapted for aligning the golf ball therebetween and aiding in the aligning of a head of the golf putter next to said upright support.

* * * * *